United States Patent [19]

Hager

[11] Patent Number: 4,616,582

[45] Date of Patent: Oct. 14, 1986

[54] WORK CLAMP FOR BUTTONHOLE SEWING MACHINES

[75] Inventor: Walter Hager, Kaiserslautern, Fed. Rep. of Germany

[73] Assignee: Pfaff Industriemaschinen GmbH, Fed. Rep. of Germany

[21] Appl. No.: 711,397

[22] Filed: Mar. 13, 1985

[30] Foreign Application Priority Data

Mar. 17, 1984 [DE] Fed. Rep. of Germany ..... 3409942

[51] Int. Cl.[4] ..... D05B 3/06

[52] U.S. Cl. ..... 112/76

[58] Field of Search ..... 112/70, 76, 114, 311, 112/312

[56] References Cited

U.S. PATENT DOCUMENTS

| | | | |
|---|---|---|---|
| 3,669,043 | 6/1972 | Nicolay | 112/76 |
| 3,713,405 | 1/1973 | Bianchi | 112/76 |
| 3,847,101 | 11/1974 | Tolle | 112/70 |
| 4,549,492 | 10/1985 | Albrecht et al. | 112/76 |

*Primary Examiner*—Werner H. Schroeder
*Assistant Examiner*—Andrew M. Falik
*Attorney, Agent, or Firm*—McGlew and Tuttle

[57] ABSTRACT

At a work clamp for buttonhole sewing machines, comprising a support plate and a clamping frame arranged at a pivotable carrying lever, spaced from the clamping frame, a hold-down device with a clamping plate resiliently pressed against the work is fastened at the carrying lever. The clamping frame, when raised is pressed into a slanting position by a spring. During the descending movement of the clamping frame and hold-down device, the hold-down device precedes the clamping frame and clamps the work to the support plate. As a next step, the edge of the clamping plate of the clamping frame which is spaced from the hold-down device impinges on the work. A clamping surface of the clamping plate forms an acute angle with the support plate. As the descending movement of the clamping plate continues, the clamping frame swings out about its bearing pin on the carrying lever. At this time the edge engaging the work moves away from the hold-down device. The work is therefore pulled smooth and stretched in the buttonhole sewing area before it is clamped by the clamping plate for the following sewing operation. By this measure, rippling of the area of the work surrounding the buttonhole is prevented.

7 Claims, 4 Drawing Figures

WORK CLAMP FOR BUTTONHOLE SEWING MACHINES

FIELD AND BACKGROUND OF THE INVENTION

This invention relates in general to sewing machines and in particular to a new and useful buttonhole sewing machine clamping device which effects the stretching of the workpiece during the clamping operation.

The invention relates in particular to a work clamp for buttonhole sewing machines by which the work is tensioned so that the buttonhole sewing area is smooth, flat and taut during the sewing operation.

A work clamp of this kind has become known through U.S. Pat. No. 2,187,235. This work clamp comprises an oval hold-down arranged device at a pivotably mounted carrying lever and resiliently tensioned against a support plate and having an opening corresponding to the buttonhole form, in which opening a tubular ram connected with the carrying lever is movable relative to the hold-down device. The support plate contains an opening matching the tubular ram, for passage of the buttonhole cutter or of the needle. As the hold-down device descends, the work placed on the support plate under the raised hold-down device is first pressed against the support plate around the cutting and sewing area and is clamped tight. In the further course of the downward movement, the tubular ram pushes the work into the opening in the support plate and in so doing tensions the sewing area to all sides like the hide of a drum.

With this work clamp, no separate drive means for tensioning the work in the sewing area are required other than the lowering device for the carrying lever, but the disadvantages of this type of tensioning is the fold formation as the material is being pulled into the bore by the ram. When working with a thick cloth, damage due to pinching is to be expected, while the tensioning of thin fabrics is not possible at all.

Through German Pat. No. 886,242 another work clamp is known, by which the work is first pressed against the work support plate completely by the work clamp frame provided with two clamping ribs, the support plate including the stitch plate. Cut into the work support plate is a groove which runs parallel to the longitudinal axis of the buttonhole and into which the work is pressed by a tensioning rod arranged movable in height next to one clamping rib so as to be tensioned in the buttonhole sewing area after it has been clamped to the support plate by the work clamping frame. The tensioning rod can be actuated for the tensioning of the work either manually by actuation of a lever or mechanically through an additional lever system which becomes operative as the sewing machine is set in motion. Pressing the work into the groove in the support plate not only involves the danger of a deformation that remains visible, but because of the arrangement of the tensioning rod on one side of the later buttonhole slit right next to one clamping rib, a transverse pull results in the fabric, which may very easily lead to a distortion of the individual threads of the fabric web in this area between the clamping ribs of the work clamping frame and thereby may cause or intensify rippling of the material, which tends to curl anyway due to the accumulation of stitches, around the buttonhole.

SUMMARY OF THE INVENTION

In accordance with the invention, a work clamp acts to pull the work without deformation in the buttonhole area and without additional drive means for the device for the stretching parallel to the direction of movement of the work clamp, and to hold it clamped without distortion during the sewing operation.

Due to the position of the hold-down device relative to the clamping frame whose clamping surface is inclined on the support plate, the hold-down device sets down on the work first as the carrying lever descends and clamps the work tight on the work support plate spaced from the clamping frame. As the downward movement continues, the lower edge of the inclined clamping surface away from the hold-down device comes into engagement with the work, the clamping frame executes a pivoting movement about its bearing axis transverse to the longitudinal axis of the buttonhole and pulls the work smooth in a work movement direction, until the clamping surface sets down in its full length on the work parallel to the support plate, securely clamping the work in a slightly stretched state in the buttonhole sewing area. Rippling is thus reliably nullified in a gentle manner.

Accordingly, it is an object of the invention to provide a clamping device for use with a buttonhole sewing machine which comprises a lever member pivotal on the sewing machine and having means for engaging the workpiece so as to stretch it in the area of the buttonhole.

A further object of the invention is to provide a sewing maching clamping device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention as illustrated.

DESCRIPTION OF THE PREFERRED EMBODIMENTS

Figure 1:
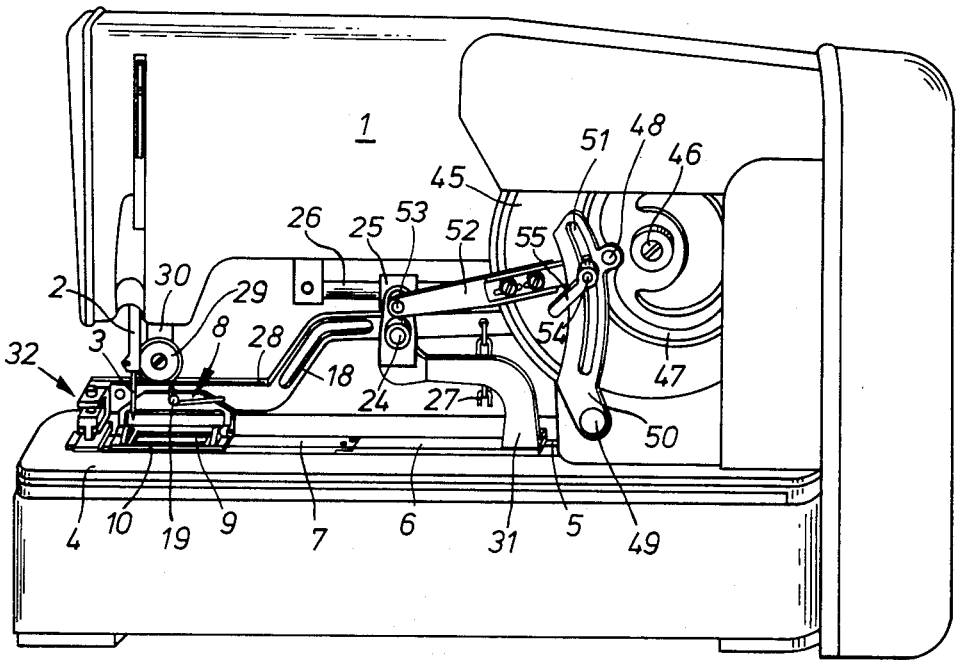
FIG. 1 shows a simplified perspective view of a buttonhole sewing machine constructed in accordance with the invention.
Figure 2:
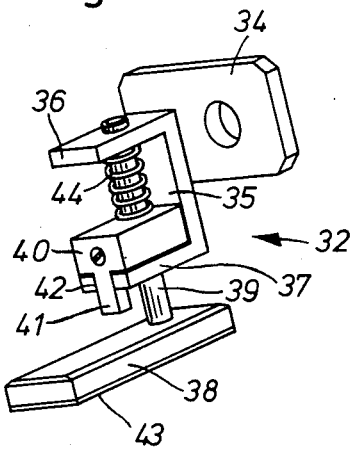
FIG. 2 is a perspective illustration of the hold-down device on a larger scale.

Referring to the drawings in particular the invention embodied therein comprises a clamping device for use with a buttonhole sewing machine generally designated 1 which has a presser bar 30 which is biased downwardly toward a workpiece W which is positioned on a support plate 7. In accordance with the invention a carrying lever is pivotally mounted on a stud 24 and effects the sewing machine in a position overlying a workpiece support plate 7. The clamping device includes a hold-down device or hold-down means 32 carried on the lever 18 and it includes a mounting bracket 35 for a clamping plate 38 which is movably supported on the bracket and is biased by spring means 44 in a direction away from the bracket. The yoke 16 is pivoted on the lever arm at a spaced location from the first clamping or presser plate 38. The yoke has first and second spaced apart leg portions 14 and 15 which are spaced axially in respect to the carrying lever 18. A second clamping plate 10 is pivotally mounted on the yoke arms for pivotal movement about an axis perpendicular to the pivotal axis of the yoke. Spring 20 biases the yoke 16 to a position in which it holds the second clamping plate obliquely in respect to the workpiece W with its end remote from the first clamping or presser plate being closer to the workpiece and the support than its end nearer to said clamping plate. The lever 18 pivots in a direction to engage the first clamping or presser plate 38 on the workpiece and hold it on the support 7 and is movable by a further amount to engage the remote end of second clamping plate on the workpiece first to cause it to grip the workpiece and stretch it as lever 18 is moved further in a pivotal motion until the whole second plate 10 engages on the workpiece.

A buttonhole sewing machine 1 has a needle bar 2 movable upwardly and downwardly pivoting perpendicular to the longitudinal axis of the machine, and a thread-carrying needle 3 cooperating for stitch formation with a shuttle (not shown) which is arranged in a base plate 4. Guided in a slot 5 in the base plate 4 is a slide 6, to which a work support plate 7 is attached which extends to below a work clamping frame 8 which together with the support plate 7 forms the work clamp. The clamping frame 8 comprises a clamping plate 10 with a slot 9 for the passage of the needle 3 and a buttonhole cutter. The clamping surface 11 of plate 10 is roughened or grooved, and it has on both narrow sides bearing brackets 12 and 13. The clamping plate 10 is articulated or pivoted at the legs 14, 15 of a yoke 16 by means of a trunnion bolt 17 directed parallel to the longitudinal axis of the machine. Yoke 16 is pivotally mounted on a carrying lever 18 about a pin 19 directed perpendicular to the longitudinal axis of the machine. Since plate 10 is pivotally mounted in this way, it adapts itself to all uneven parts of the work when it is lowered onto the work.

A thigh spring 20 is disposed on pin 19. Spring 20 has one leg 21 which is inserted in a bore in lever 18 and an other leg 22 engages on yoke 16. By spring 20, the clamping frame 8 is pressed into a raised slanted position against a stop 23. In this position the clamping surface 11 of plate 10 and the support plate 7 form an acute angle with each other.

The carrying lever 18 pivots about a bearing stud 24 in a slide piece 25 which slides on two guide bars 26 secured to the housing of the machine. Into one end of lever 18 there is hooked in the embodiment shown, a pull chain 27 for the actuation of lever 18. At the other end of lever 18 there is provided a V-shaped track 28 for a correspondingly formed roller 29 which is rotatably mounted at the lower end of a spring-loaded presser bar 30 movable vertically in the machine housing and which bears down on lever 18. The slide piece 25 is connected with the slide 6 of the support plate 7 by a bracket 31.

At the free end of carrying lever 18, the hold-down device 32 is fastened by a screw 33. It serves to clamp the work W on the support plate 7 spaced from the clamping frame 8 before frame 8 sets down on work W. The hold-down device 32 includes an attachment plate 34 to which is soldered or welded the U-shaped bearing bracket 35 in whose legs 36, 37 the clamping plate 38 is guided for axial movement by means of a slide pin 39 provided thereon. Fastened on the pin 39 between the legs 36, 37 is a guide block 40 which is confined by a projection 41 in a slit 42 in the leg 37 of the bracket 35. The sole of the clamping or presser plate 38 is covered with a covering 43 of rubber or other material having a high coefficient of adhesion. Between block 40 and leg 36 of bearing bracket 35 a compression spring 44 is arranged on the slide pin 39, by which the clamping or presser plate 38 is resiliently tensioned against the support plate 7.

For the displacement of lever 18 with the clamping frame 8 and the hold-down device 32 together with the slide 6 and support plate 7 parallel to the longitudinal axis of the machine, a control disc 45 customary in buttonhole machines is used. It is mounted for rotation about an axle 46 at the machine housing and has a control groove 47 into which extends a pin 48 of a rocking lever 50 mounted on a bearing stud 49 at the machine housing, an arcuate slit 51 being cut into the rocking lever. To reduce friction, a roller engaging into the control groove 47 is arranged on pin 48.

Motion is transmitted from the control groove 47 to the slide piece 25 connected to lever 18 and to slide 6 by a two-piece connecting rod 52 which is articulated at one end to slide piece 25 by means of a stud 53. At the other end of connecting rod 52 a screw 54 is attached which, passed through the arcuate slit 51 of rocking lever 50, is adjustable to vary the displacement path of support plate 7 and clamping frame 8 and hence the buttonhole length relative to the bearing stud 49 and is fixable by a screw lever 55.

Figure 3:
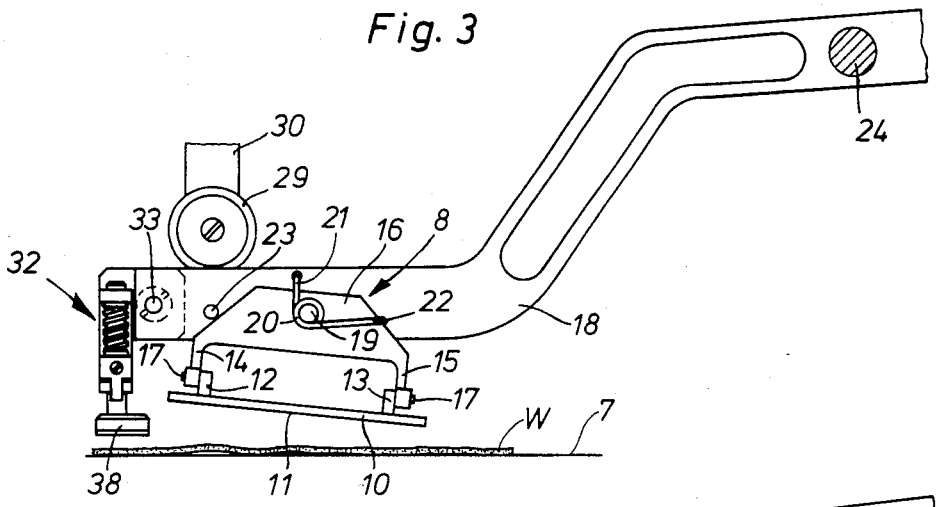
FIG. 3 is a side elevational view of the carrying lever with the work clamping frame and the hold-down device in a raised position.
Figure 4:
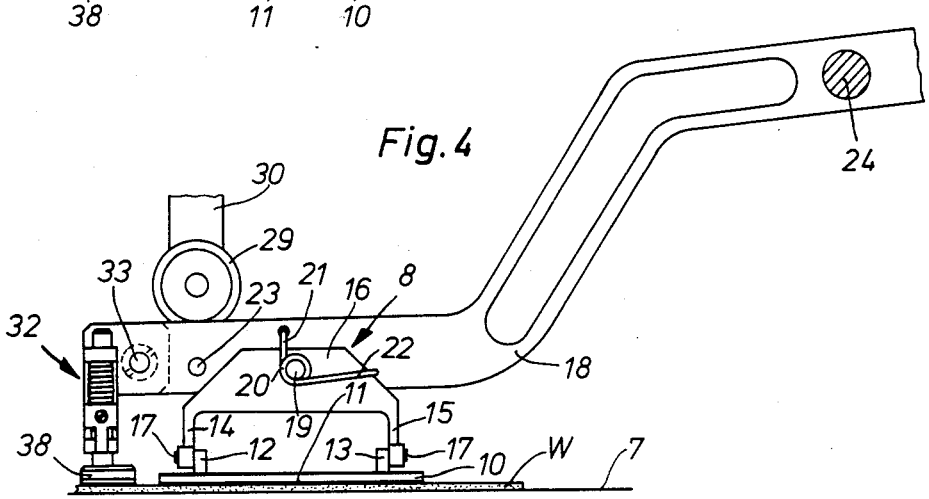
FIG. 4 is a view similar to FIG. 3 in the lowered position of the carrying lever with the work clamping frame and hold-down device in the clamping position.

When pull chain 27 is pulled downwardly, lever 18 pivots clockwise on its bearing stud 24 so that the clamping frame 8 and hold-down device 32 are lifted off the support plate 7 counter to the action of a spring which acts downwardly on the presser bar 30. This brings the parts into the position shown in FIG. 3. In this position the clamping frame 8 is pushed by the thigh spring 20 into the slanting position with the yoke 16 abutting on stop 23. The work W, for example a shirt front with a button strip into which buttonholes are to be sewn, is placed on the support plate 7 and aligned. By releasing the pull on chain 27, the carrying lever 18 is pivoted counterclockwise about stud 24 by the guide roller 29, which is biased downwardly through the spring biased presser bar 30 so that the clamping counterclockwise about stud 24 by the spring which acts on the presser bar 30 and with the guide roller 29, so that the clamping frame 8 and the hold-down device 32 are lowered. The arrangement of frame 8 and hold-down device 32 is such that the clamping or presser plate 38 of the hold-down 32, resiliently tensioned against support plate 7 by spring 44, precedes the clamping surface 11 of clamping plate 10 and therefore sets down on the work W first and clamps it on the support plate 7.

Due to the slanting position of clamping frame 8, whose clamping surface 11 forms an acute angle with the support plate 7, the edge of clamping plate 10 furthest away from hold-down device 32 impinges on the work W, as the descending movement continues, after the impingement of the work by the clamping or presser plate 38 of hold-down 32. At the end of the descending movement, the clamping frame 8 then pivots counterclockwise about the bearing pin 19, with the said edge of clamping plate 10 furthest away from hold-down device 32 moving away from the hold-down device 32, so that the work W is automatically pulled smooth and held taut in the buttonhole sewing area before the clamping surface 11 of clamping plate 10 sets down on work W by its full length and securely clamps the work on the support plate 7 in the stretched state for the sewing operation then taking place in the known manner. Rippling of the area of the work surrounding the buttonhole is thereby prevented in a simple manner.

While specific embodiments of the invention have been shown and described in detail to illustrate the application of the principles of the invention, it will be understood that the invention may be embodied otherwise without departing from such principles.

What is claimed is:

1. A work clamp for a buttonhole sewing machine having a work support plate with an area where a buttonhole is to be sewn, the buttonhole having a longitudinal axis and the sewing machine having a direction of work movement, comprising a carrying lever pivotally mounted at a pivot axis on the sewing machine and having an end which can be raised and lowered over the support plate, a clamping frame pivotally mounted on said carrying lever about an axis parallel to the pivot axis of said lever and at said end of said lever which can be raised and lowered, said clamping frame having a clamping surface for holding a work against the support plate adjacent the area where a buttonhole is sewn, spring means engaged with said clamping frame for biasing said clamping surface into an acute angle with respect to the support plate, said clamping frame being pivotally mounted on said carrying lever so that said clamping surface is movable parallel to the longitudinal axis of the buttonhole, and hold-down means having a presser plate, further spring means engaged with said presser plate for biasing said presser plate in a direction toward the support plate for clamping a work against the support plate, said presser plate being carried by said lever at a location offset in a direction of work movement so that, when said lever is lowered, said presser plate first engages the support plate before said clamping frame and while said clamping surface is disposed at the acute angle with respect to the support plate.

2. A work clamp according to claim 1, wherein said hold-down means includes a yoke member having spaced apart leg portions and the clamping surface is held by said leg portions.

3. A work clamp according to claim 2, wherein said hold-down means is arranged at a greater spacing from the pivot axis of said lever than said clamping frame.

4. A work clamp according to claim 1, wherein said clamping frame includes a yoke member having spaced-apart leg portions, a clamping plate carrying said clamping surface and mounted on said leg portions, said yoke member being pivotally mounted to said carrying lever.

5. A clamping device for use with a buttonhole sewing machine having workpiece support plate, comprising a carrying lever pivotally mounted on the sewing machine overlying the workpiece support plate, a first clamping plate movably mounted on said clamping lever, means biasing said first clamping plate toward the support plate, a yoke pivoted on said clamping lever at a spaced location from said first clamping plate and having first and second spaced apart leg portions spaced axially with respect to said lever, a second clamping plate pivotally mounted on said first and second leg portions of said yoke for pivotal movement perpendicular to the pivotal axis of said yoke, spring means biasing said yoke to a position in which said clamping plate extends obliquely with respect to the workpiece support plate with its end remote from said first clamping plate being closer to the supporting plate than its opposite near end, said lever being pivotal in a direction to engage said first clamping plate on the workpiece and hold it on the support plate, and being further movable to engage the remote end of said second clamping plate on the workpiece and cause it to grip a workpiece and stretch it as said lever is pivoted further, siad yoke pivoting until said entire second clamping plate engages the workpiece.

6. A clamping device according to claim 5, including hold-down means carried on said lever arm having a mounting bracket, said first clamping plate having a pin portion movably supported on said mounting bracket, said means biasing said first clamping plate comprising a spring biasing said first clamping plate in a downward direction away from said bracket.

7. A clamping device according to claim 6, including a presser bar biased in a downward direction, said lever having a track on its top surface engaged by a roller means on said presser bar and means connected to said lever to raise it in a direction against the biasing of said presser bar.

* * * * *